US006824295B1

(12) United States Patent
Grondal

(10) Patent No.: US 6,824,295 B1
(45) Date of Patent: Nov. 30, 2004

(54) EMERGENCY LIGHTING DEVICE

(75) Inventor: Daniel Grondal, Brookfield, CT (US)

(73) Assignee: Astralite, Inc., Brookfield, CT (US)

( * ) Notice: Subject to any disclaimer, the term of this patent is extended or adjusted under 35 U.S.C. 154(b) by 179 days.

(21) Appl. No.: 10/288,121

(22) Filed: Nov. 5, 2002

(51) Int. Cl.[7] ..... F21V 33/00

(52) U.S. Cl. ..... 362/234; 362/253; 362/812; 362/249; 362/370; 362/226; 40/570

(58) Field of Search ..... 362/234, 253, 362/812, 249, 226, 370; 40/570

(56) References Cited

U.S. PATENT DOCUMENTS 5,448,843 A * 9/1995 Schwartz ..... 40/570
D379,373 S 5/1997 Logan et al.
5,797,673 A 8/1998 Logan et al.
6,142,648 A 11/2000 Logan et al.
D446,818 S 8/2001 Kim
6,741,324 B1 * 5/2004 Kim ..... 362/249

* cited by examiner

*Primary Examiner*—Stephen Husar
*Assistant Examiner*—James W Cranson
(74) *Attorney, Agent, or Firm*—Fattibene & Fattibene; Paul A. Fattibene; Arthur T. Fattibene

(57) ABSTRACT

A combination emergency light fixture having a housing constructed to have a minimum footprint or overall configuration for housing the required components and still conform to the code requirements for such emergency fixtures. The housing includes an annular body member having a front and rear opening defining a light chamber covered by a removable sign panel and/or a mounting panel. An interior lamp source and a pair of operating batteries are disposed within the light chamber in a manner to minimize the overall footprint of the housing. Disposed between the operating battery source is a triangular shaped component compartment having light reflecting surfaces to reflect the light rays generated by the internal light source outward toward the sign panel to enhance the illumination thereof. The fixture may also include external light sources.

15 Claims, 7 Drawing Sheets

EMERGENCY LIGHTING DEVICE

FIELD OF THE INVENTION

This invention is directed to an emergency lighting device, and more specifically a combination emergency directing sign and the illumination thereof.

BACKGROUND OF THE INVENTION

Code requirements such as UL-924 code relating to emergency lighting and power equipment require that such equipment conform to the National Electrical Code ANS/NFPA 70 and the Life Safety Code ANS/NFPA 101. Section 39.5 et seq. of UL-924 code requires that the letter sizes, spacing and the overall dimension of the housing shall include any illuminated borders of the letters or, in the case of reduced size illuminated legends, the non-illuminated (opaque) borders of the illuminated letters.

Some of the known efforts made to conform to the code requirements are evidenced by lighting fixtures disclosed, e.g. in U.S. Pat. Nos. 6,142,648 and 5,797,673. These known lighting fixtures have a housing which is required to be greater than the heretofore standard electric signage to provide space for accommodating such auxiliary components as batteries, circuitry and other components necessary for operating the emergency lamping carried exteriorly of the housing during an emergency. Lighting fixtures such as the type disclosed in U.S. Pat. Nos. 6,142,648 and 5,797,673 have also been made the subject of Design Patents, e.g. U.S. Design Pat. DES 446,818 and U.S. Design Pat. DES 379,373. The noted design patents appear to be directed to a lighting fixture which also requires an oversized housing for accommodating the other necessary components such as relatively large batteries required for powering the exterior lamps in the event of an emergency situation, e.g. a blackout, fire, and the like. This is readily apparent in the noted design patents, as the overall dimension of the housing extends substantially below the required dimensions of the exit sign which is sized to satisfy the specified code dimensions for such lettering. As a result, there is a need to have an emergency lighting device with more compact housing which can still satisfy the minimum code requirements.

SUMMARY OF THE INVENTION

An object of the present invention is to provide a combination emergency lighting fixture having a minimum sized housing while accommodating a lighted emergency sign that complies with the electrical code, UL-924 specifications.

Another object is to provide a combination emergency lighting fixture wherein the illumination cavity for the emergency sign is substantially co-extensive to that of the housing of the fixture.

Another object is to provide a combination lighting fixture having increased versatility whereby it can be readily converted between a double face illuminated emergency sign or a wall mounted sign.

Another object of the invention is to provide a combination emergency fixture having a housing constructed in a manner whereby accessibility to the interior of the housing for effecting replacement and/or repair of any component part is simplified.

Another object is to provide a combination emergency lighting fixture with a housing which is constructed to reflect the internal light rays toward the emergency sign so as to enhance the illumination thereof.

Another object is to provide a combination emergency lighting fixture having an exterior light source incorporated onto the opposed end walls of the housing and/or can be remotely placed relative to the fixture.

Another object is to provide an emergency lighting fixture with a simplified housing construction having readily interchangeable opposed panels to function as a sign panel or a mount or support for the fixture.

Another object of the invention is to provide for a combination emergency light fixture having a housing which is rendered readily adaptable for use as a single or double faced fixture.

The foregoing objects and other features and advantages are obtained by the combination emergency light fixture having a housing in the form of a unitary annular member having a readily removable front and back panel capable of functioning as a sign panel or a support or mounting panel. The respective front and back panels are constructed so as to be readily removable without the use of any tools, and which are positively secured to the annular housing member in the operative position. The annular housing member may also be provided with integrated opposed arcuate side walls for accommodating exterior emergency lighting units. In accordance with this invention, the housing in its assembled position defines a lighting chamber which is substantially equal to the dimensions of the compact housing and still comply with the requirements of the UL-924 code for such combination emergency light fixtures. This is attained by the construction of the annular member with opposed interior partitions disposed between the top and bottom walls thereof to define opposed battery holding chambers which are wholly disposed within the lighting chamber. The respective opposed partitions are provided with an outwardly inclined wall portion to accommodate an illuminated directional indicator as required by UL-924 code. The respective partitions provide the internal supports sufficient to support the weight of the batteries for powering the lamps during an emergency or loss of power. Disposed between the partitions there is provided a component compartment for containing a circuit board and other electrical circuit components. The component compartment is defined by inclined opposed sides which converge inwardly of the light chamber to define a generally triangularly shaped compartment. The arrangement is such that one of the compartment walls is rendered readily removable to provide easy access to the electrical components.

In accordance with this invention, the inclined walls of the component compartment have a reflective surface for reflecting the light rays generated by the internal light source outwardly toward the sign panels to enhance the illumination thereof. The internal light source includes a light bar disposed along the top portion of the annular member for supporting thereon a plurality of spaced LED lamps. If desired, the exterior light source may also be remotely disposed relative to the emergency light fixture.

Other features and advantages of the invention will become readily apparent in view of the following detail description and the drawings.

IN THE DRAWINGS

DETAILED DESCRIPTION

Figure 1:
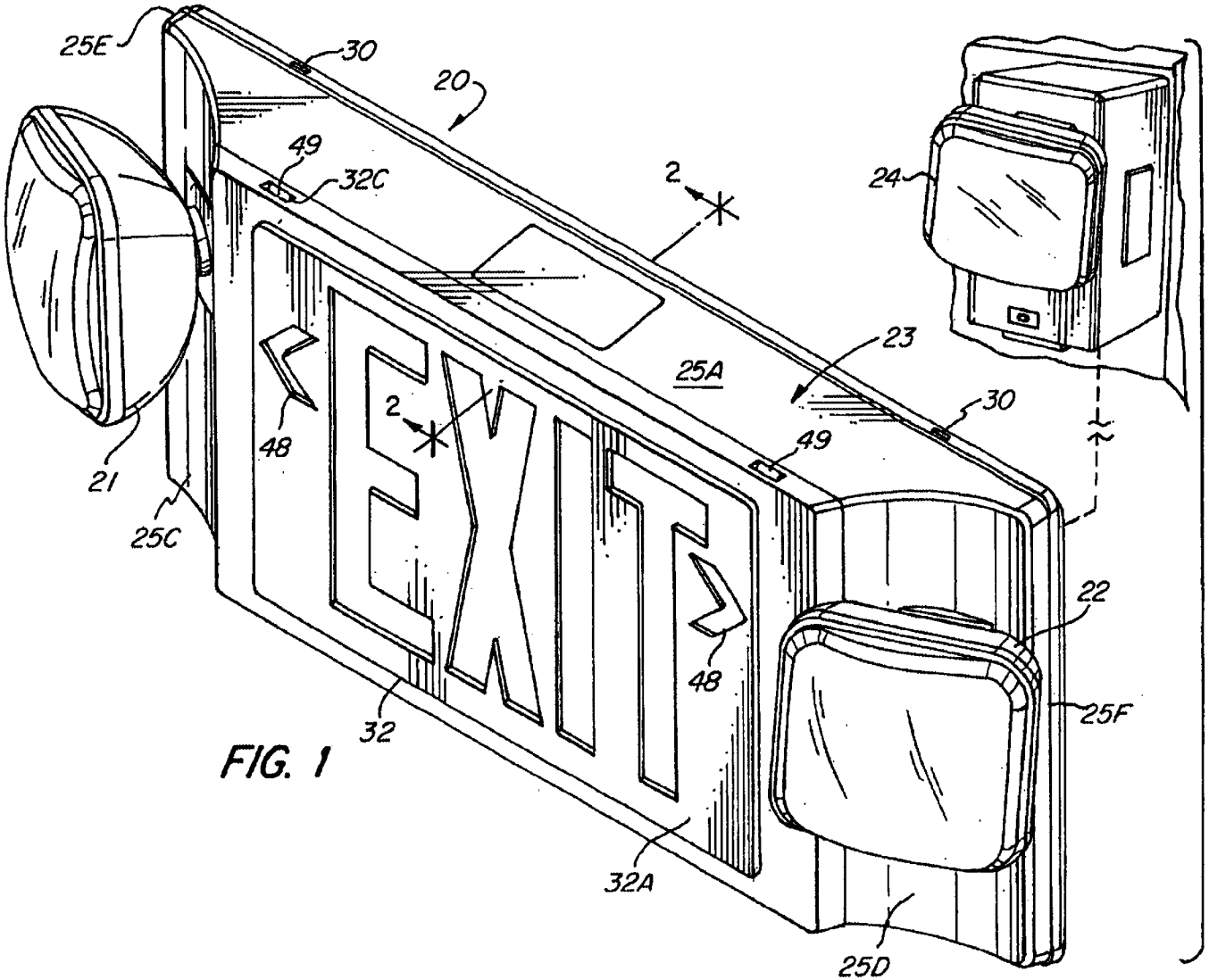
FIG. 1 is a perspective view of a combination light fixture embodying the invention wherein the external light source may be either mounted on the fixture and/or at a location remote therefrom.

Referring to the drawings, FIG. 1 illustrates a perspective view of a combination emergency light fixture 20 embodying the present invention. As used herein, combination emergency light fixture 20 means a light fixture capable of having an internal light source for illuminating a sign or direction panel, e.g. an exit sign or the like, which may also have an external light source. The arrangement is such that the fixture 20 may be powered both by an AC line current and/or a battery source. Preferably, the light source for the fixture 20 is powered by a direct line source generating alternating (AC) current and having an auxiliary battery power source to power the light sources in case of a power outage, fire or other form of an emergency.

In FIG. 1, the illustrated fixture 20 is shown as having a pair of external lamps 21 and 22 adjustably mounted on the arcuate sides or wings 25, 25 of the housing 23. If desired, the external lamps 21, 22 may be optionally located at a remote distance from the fixture 20 as shown by external lamp 24 in FIG. 1. Alternatively, the fixture 20 may be used with both the housing mounted lamps 21, 22 and the remotely mounted lamps such as lamp 24.

In accordance with this invention, the housing 23 includes an annular housing member 25 having a top 25A, a bottom 25B and interconnected opposed sides 25C and 25D. The opposed sides 25C, 25D are preferably arcuate in shape to define opposed wings or sides 25C, 25D for supporting thereon the external lamps 21 and 22. The opposed sides 25C, 25D terminate in a rearwardly extending flange 25E and 25F which circumscribes annular housing 23 to define a full back opening 26. Disposed between the opposed wings or sides 25C, 25D and the top 25A and bottom 25B of the annular housing member 23 and opposite the full back opening 26 is a front opening 27.

Figure 5:
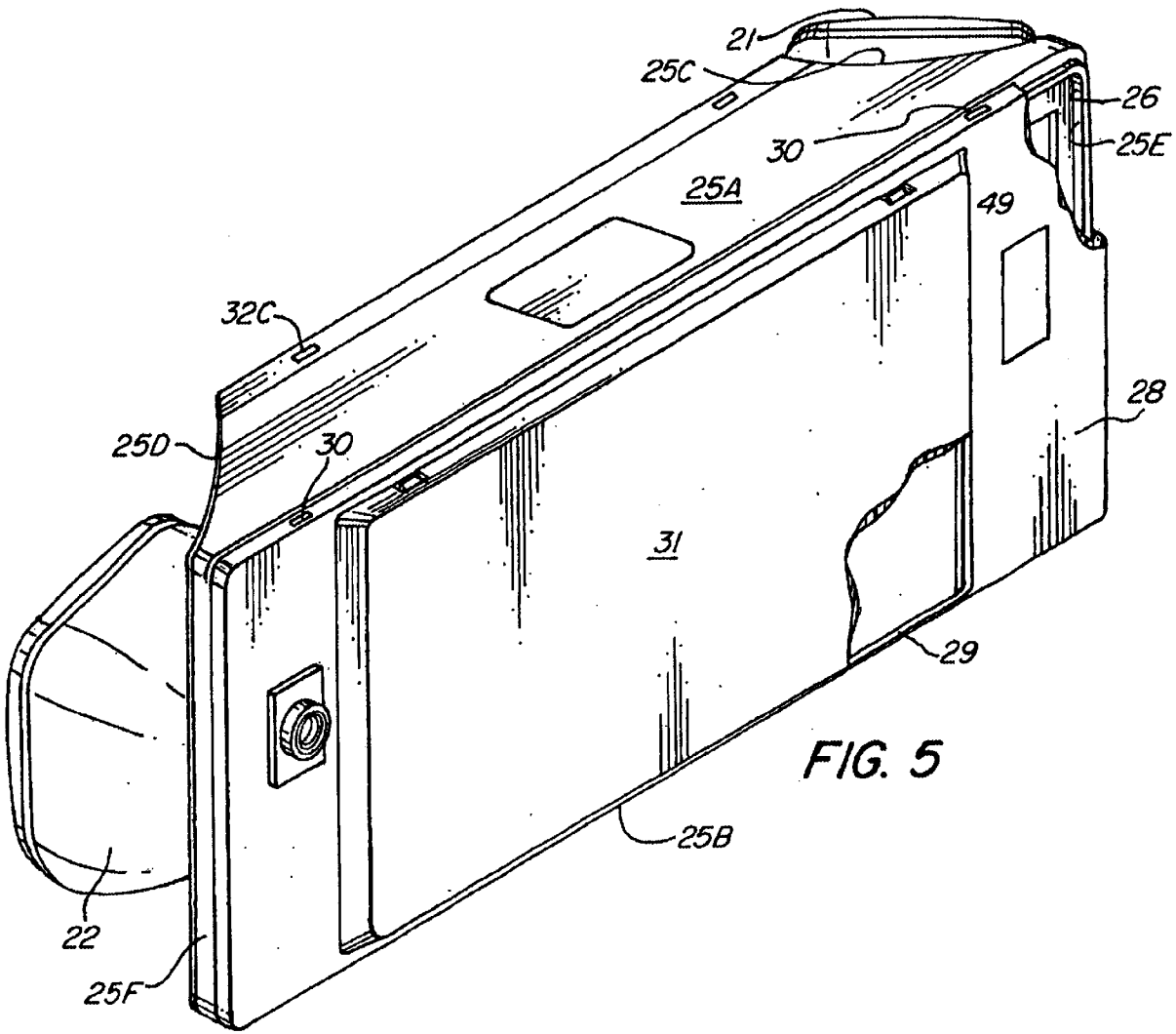
FIG. 5 is a perspective view of the combination emergency light fixture as viewed from the rear.

Connected to the rearwardly extending flanges 25E and 25F circumscribing and defining the full back opening 26 is a sub-back panel 28. As best seen in FIG. 5, the sub-back panel 28 is provided with a back opening 29 which is substantially co-extensive in size to the front opening 27. In accordance with this invention, the back sub-panel 28 is provided with top and bottom slots 30, whereby the back sub-panel 28 can be readily detachably connected to the annular housing member 25 as will be hereinafter described.

Figure 4:
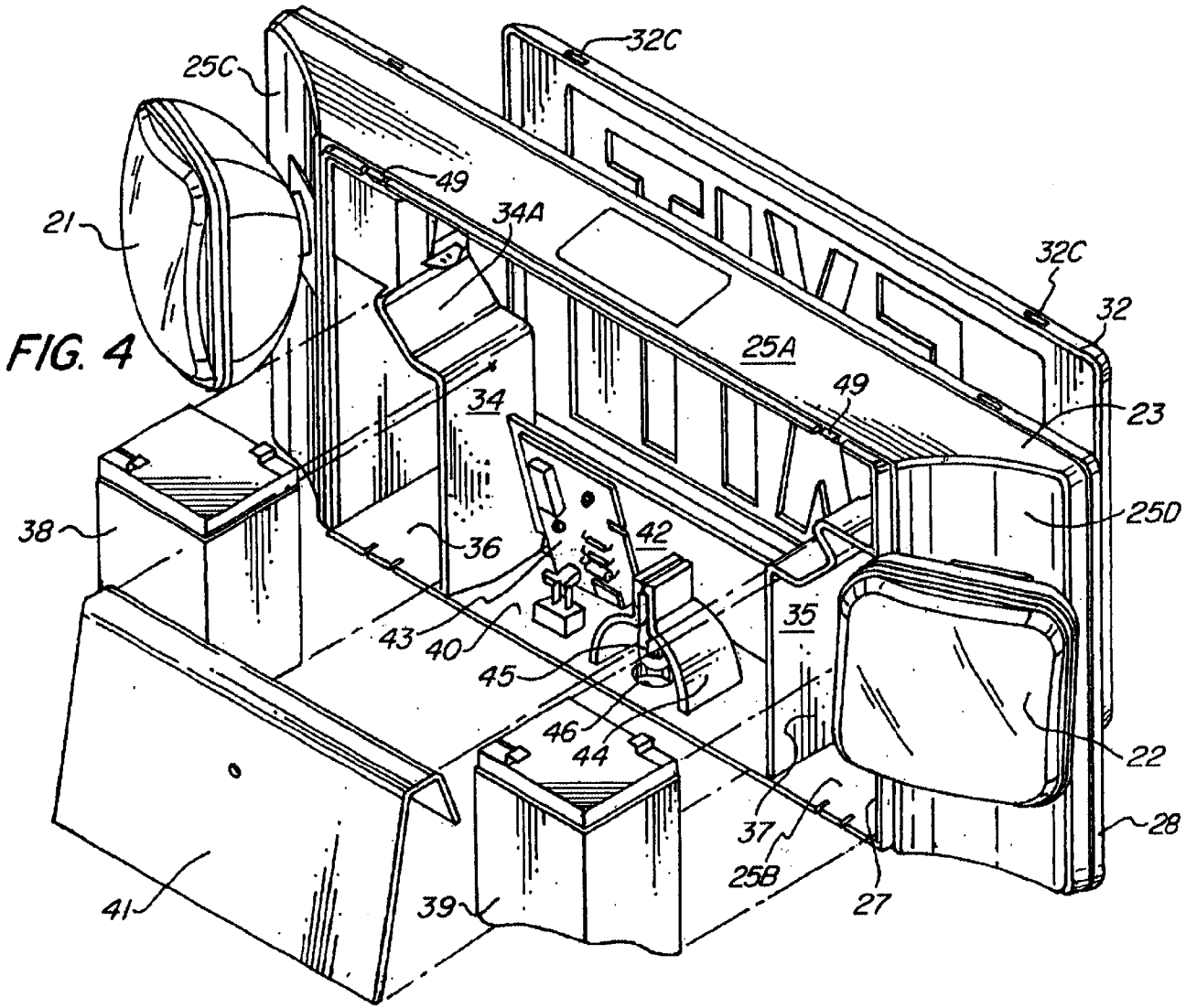
FIG. 4 is a perspective exploded view of the combination emergency light fixture similar to that of FIG. 1, illustrating the same for use as a double faced unit and having one face removed.

As seen in FIG. 5, the back opening 29 formed in the back sub-panel 28 can be covered by a detachable back panel 31 or can be optionally covered by a detachable sign panel 32 as indicated in FIG. 4. The removable back panel 31 is thus rendered interchangeable with the sign panel 32. As will be hereinafter described, the respective back panel 31 and the sign panel 32 are secured to the sub-back panel 28 by a similar snap fitting retainer or fastening means as will be hereinafter described.

Figure 3:
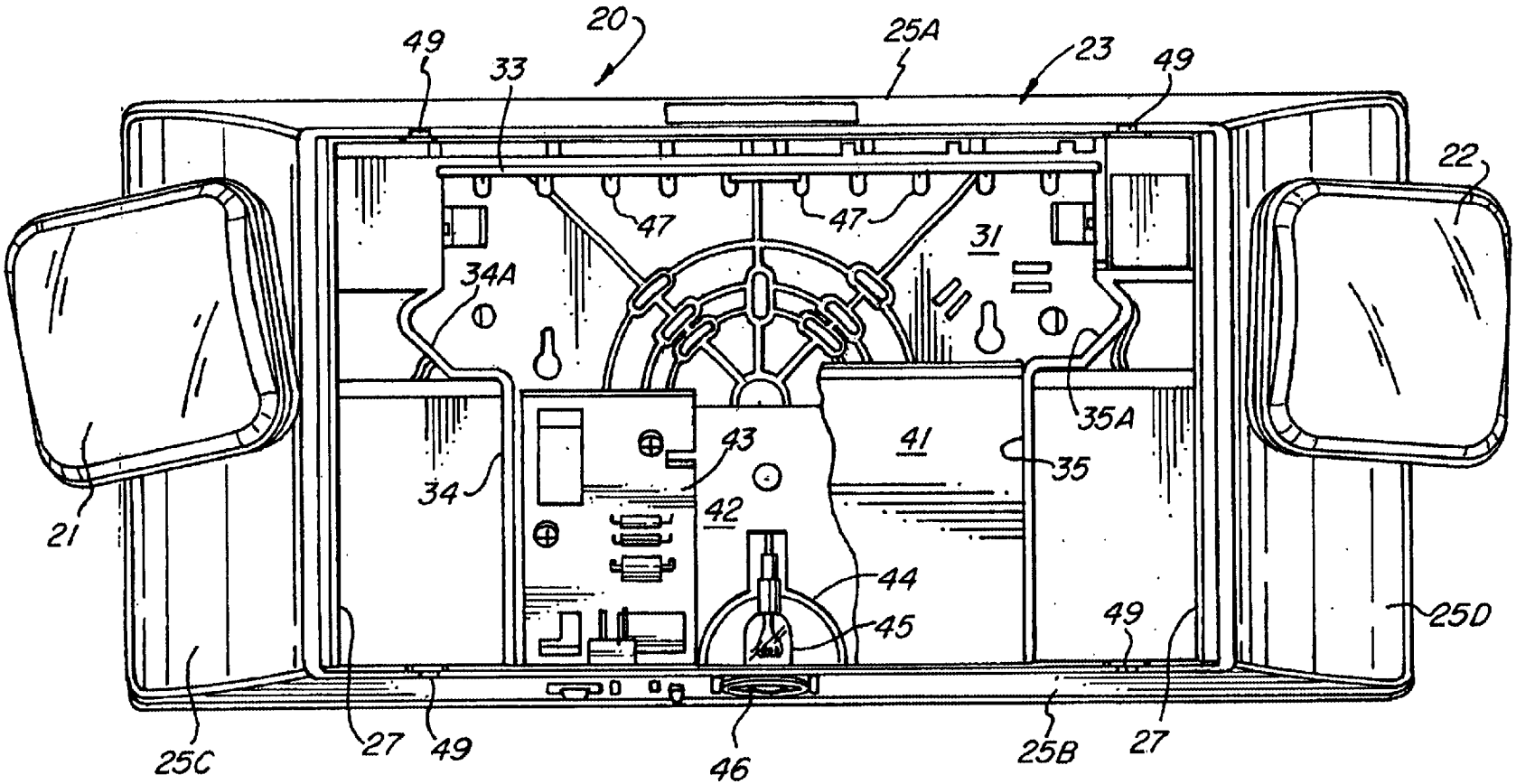
FIG. 3 is a front view of the housing construction of FIG. 1 with the front sign panel removed.

Referring to FIG. 3, the annular housing member 25 is provided with an inner cross piece 33, spaced slightly inwardly and parallel to the top 25A of the annular housing member 25. As shown, the cross piece 33 is supported between the upper ends of a pair of spaced apart partitions 34, 35 extending between the bottom 25B of the annular member 25 and the upper cross piece or plate 33. As best seen in FIG. 3, the respective partitions 34, 35 are bent or bowed outwardly above the mid point of the respective partitions 34, 35 as noted at 34A, 35A. The arrangement of the partitions 34, 35 relative to the sides or wings 25C, 25D respectively define a battery chamber 36, 37 for housing a battery 38, 39 therein.

Figure 2:
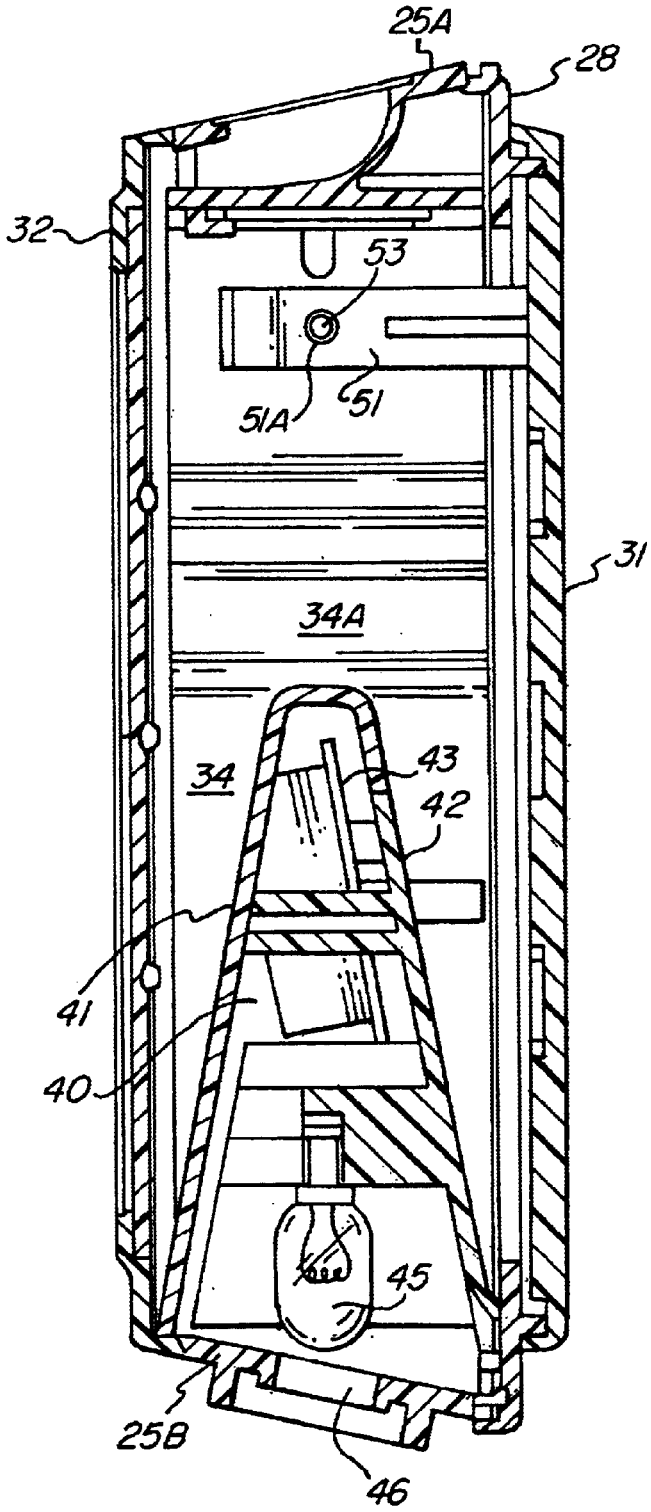
FIG. 2 is a sectional end view taken along line 2—2 on FIG. 1.

Disposed within the annular housing member 25 and between the respective partitions 34, 35 is an inner compartment 40 for housing the electrical components and/or the circuitry required for energizing and controlling the powering of the lamps or light sources. As best seen in FIGS. 2 and 4, the inner component compartment 40 is defined by opposed sides 41, 42 that are inclined and converge inwardly of the housing member 25 to define a component compartment 40 that is generally triangular in cross section as seen in FIG. 2. The component compartment 40 extends upwardly from the bottom wall 25B of the annular housing 25 to about a midpoint of the annular housing 25.

In the illustrated embodiment, one side 41 of the compartment 40 is rendered readily removable so as to provide ready access to the component compartment 40. Within the component compartment is a printed circuit board 43 or equivalent circuitry for operating the lamps or light sources. Also disposed within the component compartment 40 is a lamp holder 44 for supporting an internal lamp 45 for directing light rays outwardly through an opening 46 formed in the bottom wall 25B of the annular housing member 25.

Supported on the top cross piece or plate 33 are a series of LED lamps 47 for illuminating the interior of the light chamber. In accordance with this invention, the sides 41, 42 of the component compartment 40 are inclined inwardly at an angle relative the front and back openings 27, 29 so as to reflect and direct the light rays generated by the LED lamps 47 outwardly toward the respective front and back openings 27, 29. The opposed sides 41, 42 are formed so as to have an outer reflective surface for reflecting more of the light rays toward the sign panels 32 that cover the front or back openings 27 or 29 to enhance the illumination of the sign panel 32.

Figures 6, 7, 8:
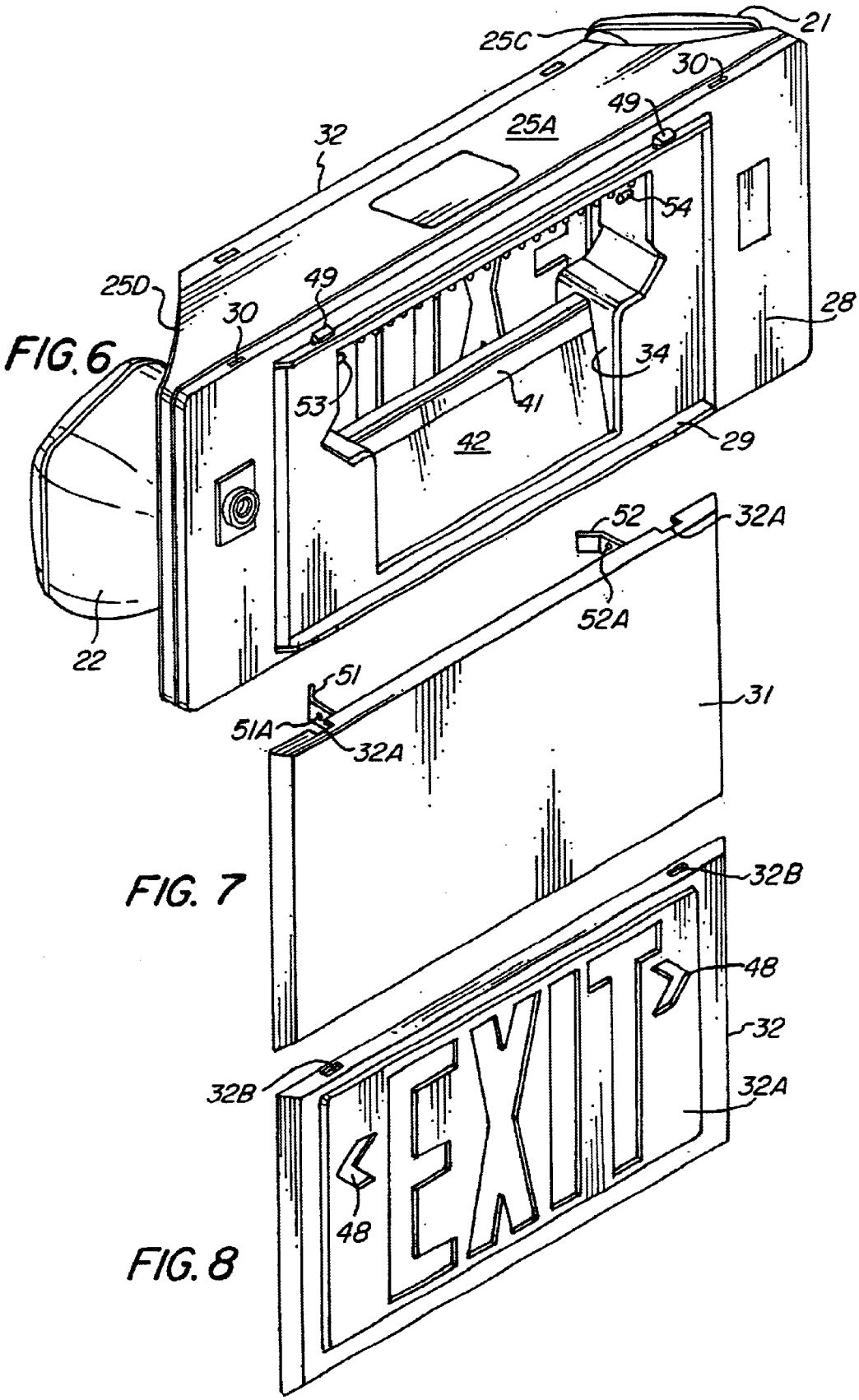
FIG. 6 is a perspective view similar to FIG. 5 with the back panel removed.
FIG. 7 is a detail perspective view of the back or support panel.
FIG. 8 is a perspective detail view of a sign panel which can be rendered readily interchangeable with the back or support panel of FIG. 7.

As shown in FIG. 1 and FIG. 8, the sign panel 32 comprises a planar surface 32A having a suitable sign, e.g. the letters E X I T formed thereon, which are illuminated when the LED lamps 47 are illuminated. It will be understood that the sign panel 32 may be formed to give any other desired "direction" or "phrase" e.g. STAIRS; -THIS WAY; or other instruction generally given in cases of an emergency. Also, the sign panel 32 may be provided with a direction indicator or arrow, as shown at 48, which is also illuminated by the LED lamps 47. In accordance with this invention, the direction indicators 47 are located on the planar surface 32A of the sign panel 33 so as to be disposed opposite the outward bowed portions 34A, 35A of partitions 34, 35.

Figure 11:
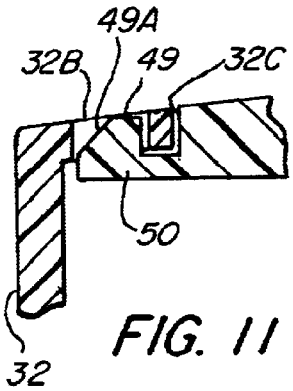
FIG. 11 is a fragmentary detail section view illustrating a front or back panel in the latched or secured position.
Figure 10:
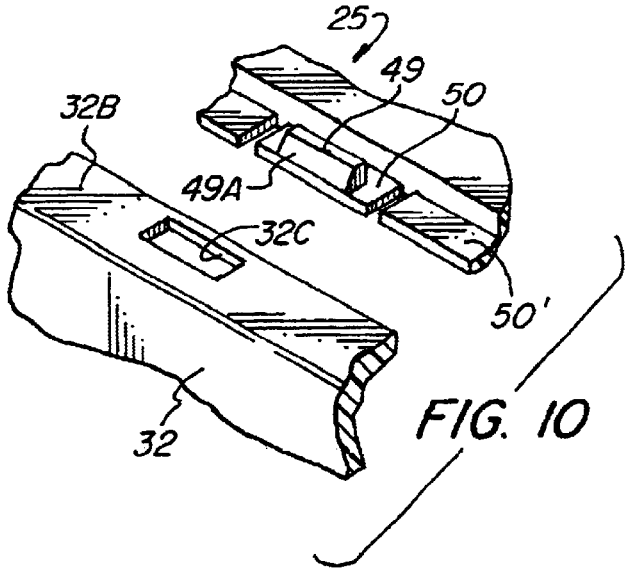
FIG. 10 is an exploded detail view of the latching arrangement for securing the front or back panels to the housing annular member.

As noted in FIG. 1 and FIG. 8, the sign panels 32 are similarly formed so as to be readily interchangeable. The sign panels are detachably secured to the front of the annular housing member 25 by means of a snap fit retainer, as best illustrated in FIGS. 10 and 11. The illustrated retainer means as seen in FIGS. 10 and 11 are shown as having the flange portion 32B of the sign panel 32 formed with a slotted opening 32C, which is adapted to be disposed in alignment with a complementary latching detent 49 formed on the complementary edge or flange 50 of the annular housing 25. As the annular housing member 25 is formed of a suitable plastic material, the flange 50 being slightly spaced or separated from the circumscribing flange 50' defining the periphery of the annular member 25 is rendered resilient and free to deflect when the sign panel 32 is fitted onto the front opening 27. As noted in FIG. 10, detent 49 is provided with a slightly angled face 49A which effects a camming action to deflect the flange portion 50 downwardly, as seen in FIG. 10, when the front sign panel 32 is fitted to the annular housing member 25. The inherent resiliency of the flange portion 50 will cause the detent 49 to engage the slot 32C and lock the front sign panel onto the annular member. As noted in FIG. 1, the front sign panel is provided with a pair of slots along the top and bottom edges thereof which are in alignment with a pair of detents 49 formed in the upper and lower peripheral portions of the annular member 25.

It will be noted that the back sub-panel 28 is detachably connected to the rear portion of the annular housing member 25 with similar snap fit assembly as described with respect to FIGS. 10 and 11. Likewise, the back panel 31, functioning as a closure and mounting plate, is also secured to the back sub-panel in a similar manner. In addition, the back panel 31 is provided with a pair of spaced apart resilient clips 51, 52 arranged to extend into the light chamber. Each of the respective clips 51, 52 has formed therein an aperture 51A, 52A which are adapted to receive a pin 53, 54 located on the opposed partitions 34, 35. The arrangement is such that when the back closure panel 31 is fitted to the back sub-panel to cover the rear opening 29, the clips 51, 52 will engage pins 53, 54 and will be received in apertures 51A, 52A when the apertures are positioned opposite the pins 53, 54. At the same time, the slots 32A (as seen in FIG. 7) will engage the detents 49 to secure the back panel onto the sub-back panel 28.

The sign panel 32, as noted in FIG. 8, which is interchangeable with the back panel 31, is similarly secured to the sub-back panel 28 by means of the slots 32B engaging the detents 49 as hereinbefore described.

When the combination emergency fixture 20 is utilized with the back panel 31, as described, the back panel 31 can be readily secured or fixed to a supporting surface, e.g. a wall, by means of any type of suitable fasteners, e.g. screws, nails, adhesives and the like. The arrangement is such that the annular housing member 25 and the connected sub-back panel 28 can be rendered readily disengaged from the wall secured back panel 31 simply by effecting the removal of the front sign panel 32 as herein described, and releasing the clips 51, 52 by deflecting the clips toward each other to free the locking pins 53 and 54. The front sign panel 32 can be readily released by depressing the detents 49 to disengage the detent from the corresponding slot 32B.

From the foregoing description, it will be apparent that the emergency light fixture 20 can be utilized either as a single face or double face emergency light fixture with either attached exterior light source and/or remotely placed light source. Further, the components of the light fixture are rendered readily detachably connected by snap fit retaining means to provide easy and readily accessible to the working electrical components for repair or replacement of parts.

Figure 9:
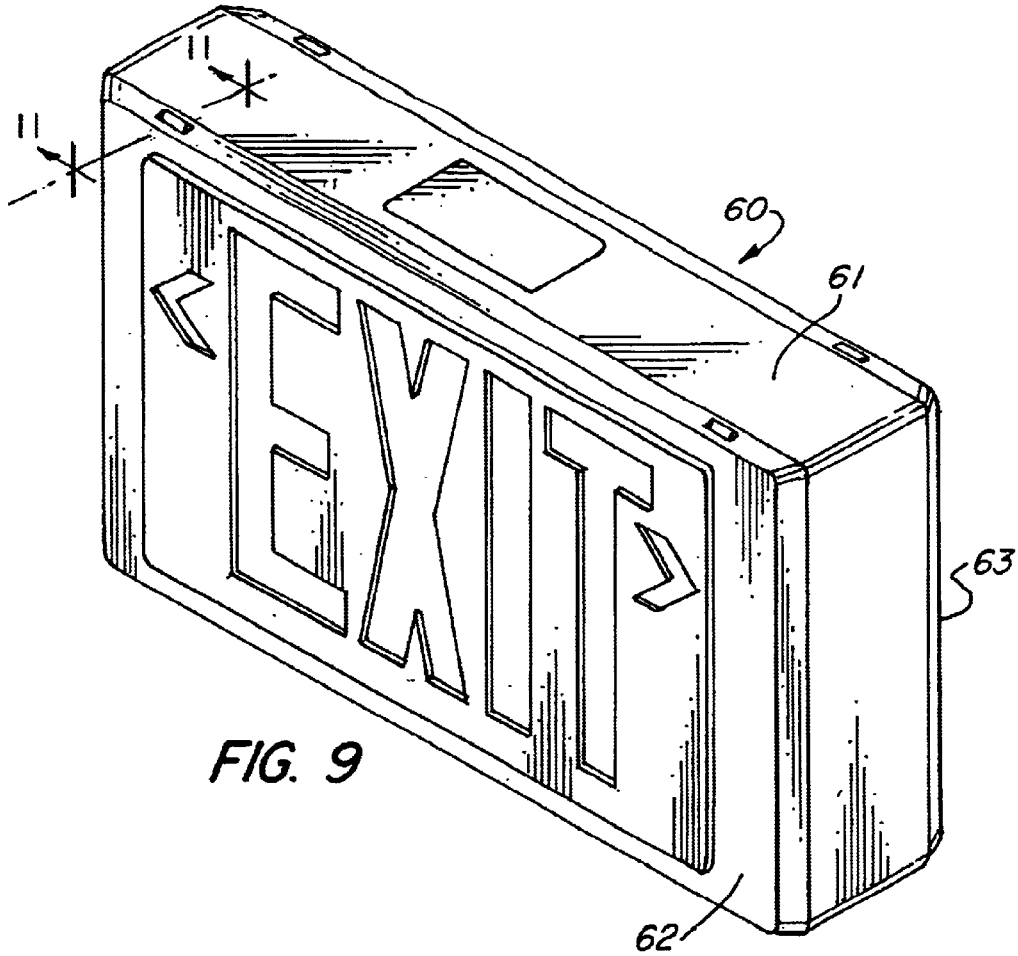
FIG. 9 is a perspective view of a modified light fixture.

FIG. 9 illustrates a modified embodiment. In the embodiment of FIG. 9, the emergency lighting fixture 60 is devoid of any external lighting means. In this simplified embodiment, the annular housing member 61 is rectangular in shape to define a full front and rear opening which may be closed by a sign panel 62 similar to that described herein with respect to FIGS. 1 and 8; and a back panel 63, which is rendered interchangeable with a sign panel 62, as hereinbefore described. The internal structure of the annular housing 62 is similar to that herein described with respect to the embodiment of FIGS. 1 to 5.

The embodiments herein described function so as to enhance the illumination of the interior lighting chamber to maintain the sign and direction indicators illuminated at all times, and which illumination is backed up with a battery source of power in the event of any interruption of the line current. The emergency fixture of this invention is rendered compact in that the electrical components are arranged within a component compartment within the lighting chamber, and which component compartment is uniquely formed and shaped to reflect the light generated by the interior light source outwardly toward the sign panel to enhance the illumination thereof, and whereby the code requirement for such emergency fixtures can be complied with in a more compact housing.

While the present invention has been described with respect to a several embodiments, modifications and variations may be made without departing from the spirit or scope of this invention.

What is claimed is:

1. An emergency light fixture comprising:

a housing, said housing including an annular member having a front and back opening to define a light chamber, said member having a pair of spaced apart partitions to define within said annular member a pair of opposed battery chambers, a component compartment disposed between said partitions within said annular housing member, said component compartment having opposed inclined sides converging inwardly toward one another to define a generally triangular compartment in cross-section, said inclined walls having a reflective outer surface, a light source disposed within said annular member, a front sign panel covering said front opening, and a panel covering said back opening whereby the light generated by said light source is reflected off said sides of said component compartment toward said sign panel to enhance the illumination thereof.

2. An emergency light fixture as defined in claim 1 and including a snap fitting retaining means for detachably securing said panels to said annular housing member.

3. An emergency light fixture as defined in claim 2 wherein said snap fit retaining means include complementary detent and slot means, said annular housing member having a plurality of said detents circumferentially spaced about the periphery defining said front and rear openings, and said panels, each having a plurality of complementary slots circumferentially spaced apart the respective periphery thereof adapted to be disposed in alignment with said corresponding detent to effect a releasable detachment when said panels are fitted to the respective front and rear openings.

4. An emergency light fixture as defined in claim 1 wherein said annular member includes opposed wings extending laterally of said front opening to define a full rear opening grater than said front opening, a sub-back panel detachably connected to said annular housing member, said sub-back panel having a reduced opening therein that is substantially equal in size to said front opening, a sign panel covering said front opening detachably secured to said annular housing member, a panel detachably connected to said sub-back panel to cover said reduced opening, and an external emergency light source connected to each of said wings.

5. An emergency light fixture as defined in claim 4 and including an emergency light source remotely removed from said emergency light fixture.

6. An emergency light fixture for use as an illuminated emergency sign comprising:

a housing, said housing including an annular member, said annular member having opposed top and bottom walls and interconnected opposed side walls to define a front and rear opening, a pair of opposed spaced apart partitions extending between said top and bottom walls within said annular member, said partitions being spaced inwardly from said side walls to define therebetween a compartment sized to receive a battery, a light source disposed between said partitions adjacent said top wall, a component compartment disposed between said partitions, said component compartment including opposed sides that converge toward an apex inwardly of said annular housing member, said component compartment being substantially triangular in cross-section, a sign panel covering at least one of said openings whereby the light generated by said lamp source is reflected off the sides of said component compartment and directed toward said sign panel to enhance the illumination thereof, and a second panel covering the other of said openings.

7. An emergency light fixture as defined in claim 6 wherein said second panel comprises a sign panel to define a double face fixture.

8. An emergency light fixture as defined in claim 6 wherein said second panel is a mounting panel.

9. An emergency light fixture as defined in claim 6 and including a back sub-panel detachably connected to said annular member to define a back sub-panel opening coextensive with said front opening, and a panel detachably connected to said back sub-panel to cover said sub-panel opening.

10. An emergency light fixture comprising:

a housing of minimum size and suitable for complying with applicable code restrictions relating to said emergency light fixture, said housing including an annular body member having a top, bottom and interconnecting side walls to define a front and rear opening, said annular body member defining a light chamber, a pair of spaced apart chambers for supporting a battery disposed within said annular body member, a component compartment disposed between said opposed battery chambers, said component compartment including opposed upwardly and inwardly inclined sides to define a substantially triangular compartment in cross-section, an internal light source disposed within said light chamber adjacent said top wall of said annular body member, a sign panel detachably connected to said annular body member for covering said front opening, and a second panel means connected to said annular body member for covering said rear opening, means for detachably connecting said second panel means to said annular body member, and said component compartment having a light reflecting outer surface for reflecting the light generated by said internal light source toward said sign panel to enhance the illumination thereof, and a light source connected externally of said annular body member.

11. An emergency light fixture as defined in claim 10 wherein one side of said component compartment is rendered readily removable.

12. An emergency light fixture as defined in claim 10 wherein said second panel comprises a second sign panel, and said light reflecting surface of said component compartment reflects the light generated by said internal light source toward each of said sign panels.

13. An emergency light fixture as defined in claim 10 wherein said second panel comprises a back sub-panel detachably connected to said annular body member, said sub-back panel having an opening formed therein corresponding in size to said front opening, and a cover panel forming a closure for said back sub-panel opening.

14. An emergency light fixture as defined in claim 13 wherein said cover panel comprises a sign panel.

15. An emergency light fixture as defined in claim 14 wherein said sign panels include a direction indicator.

* * * * *